United States Patent [19]

Bailey et al.

[11] Patent Number: 4,644,830

[45] Date of Patent: Feb. 24, 1987

[54] RATCHET WRENCH

[76] Inventors: Roy E. Bailey, 44 Water St., Clifton, Tenn. 38425; Ben J. Bailey, 901 Michigan St., Brighton, Mich. 48116

[21] Appl. No.: 667,844

[22] Filed: Nov. 2, 1984

Related U.S. Application Data

[63] Continuation-in-part of Ser. No. 424,093, Sep. 27, 1982, Pat. No. 4,488,459.

[51] Int. Cl.[4] ..... B25B 13/46

[52] U.S. Cl. ..... 81/58.2; 81/60

[58] Field of Search ..... 21/60–63.2, 21/58.2, 90.1, 185.1, 179; 74/577 R, 577 M, 577 S, 575; 192/43.1

[56] References Cited

U.S. PATENT DOCUMENTS

| | | | |
|---|---|---|---|
| 1,756,717 | 4/1930 | Wiedeke | 81/61 |
| 2,659,257 | 11/1953 | Thompson | 81/90.1 |
| 2,700,315 | 1/1955 | Hermanson | 81/58.2 X |

FOREIGN PATENT DOCUMENTS

| | | | |
|---|---|---|---|
| 229886 | 10/1968 | U.S.S.R. | 192/43.1 |

*Primary Examiner*—Robert P. Olszewski
*Assistant Examiner*—Debra S. Meislin
*Attorney, Agent, or Firm*—James M. Deimen

[57] ABSTRACT

A closed or open end ratchet wrench head comprising a substantially hollow cylindrical body with a plurality of recesses or pockets formed therein in communication with the central opening of the cylindrical body. A plurality of flexible, swinging pawls that acts as jaw members are located in the recesses and extend into the central opening of the body for direct contact with a nut or bolt head. The recesses and pawls are shaped to retain the pawls within the recesses while permitting the pawls to flex as required during ratching movement. The flexible pawls eliminate the need for separate hardened steel pawls and springs. In an alternate embodiment, the pawls comprise hardened metal slugs extending into the central opening from peripheral recesses tangentially in communication with the central opening. The pawls are urged into the central opening by separate springs within the recesses. The pawls engage the nut flats with area contact and are supported with area contact by thrust walls in the wrench head recesses. In a second alternate embodiment channel or "C" shaped hardened metal pawls extend partially into the central opening from peripheral recesses. The recesses and pawls are shaped to retain the pawls within the recesses while permitting the pawls to swing or rotate during ratcheting movement.

16 Claims, 21 Drawing Figures

FIG.13
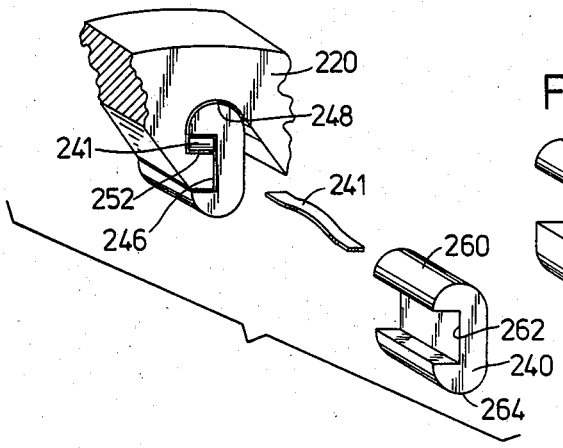
FIG.14
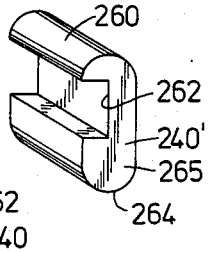
FIG.12
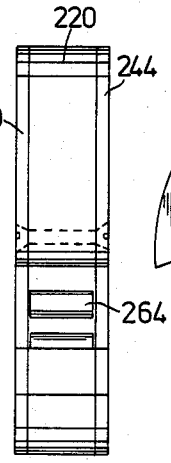
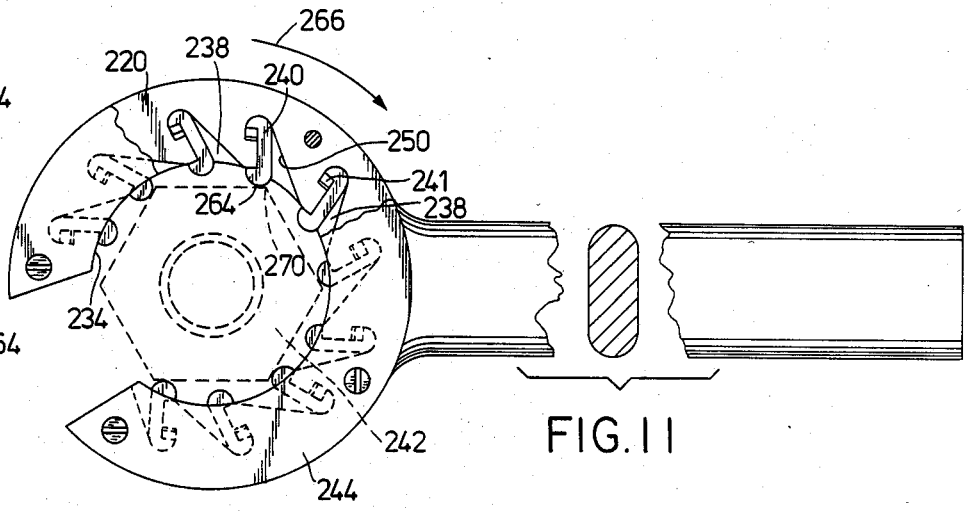
FIG.11
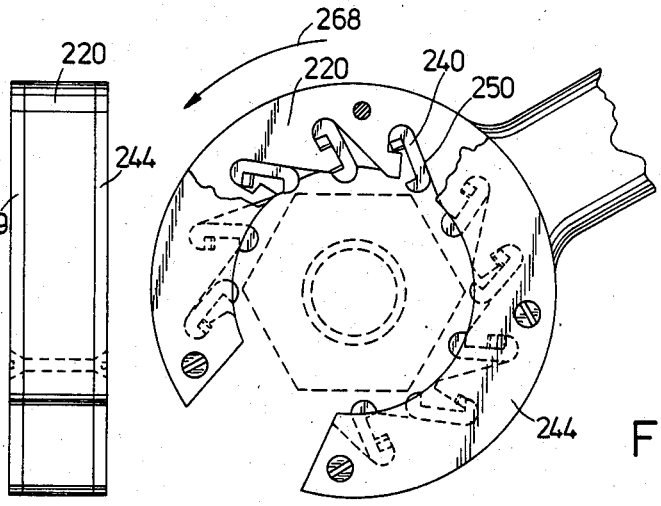
FIG.15
FIG.16

RATCHET WRENCH

BACKGROUND OF THE INVENTION

This application is a continuation-in-part of application Ser. No. 424,093, filed Sept. 27, 1982, now issued U.S. Pat. No. 4,488,459.

The field of the invention pertains to wrenches and, in particular, to open and closed (box) end wrenches.

Most commonly, ratchet wrenches utilize a pawl and gear assembly movable in the ratcheting direction relative to the wrench head and handle as illustrated in U.S. Pat. No. 2,500,835. The gear has a central opening therethrough formed to engage the complementary surfaces of a nut or bolt head. Such a construction, although very suitable for a box or closed end wrench where the gear surrounds the nut or bolt head, is not suitable for an open end ratcheting wrench.

Open end ratcheting wrenches utilize a plurality of individual hardened steel rollers extending from recesses in the wrench head into the central opening for engagement with a nut or bolt head. In the form best known to applicant a single spring set in a peripheral slot about the central opening urges the rollers toward the central opening. The configuration requires several relatively expensive machining steps to form the individual roller recesses and the peripheral slot. The assembly of the wrench requires the spring and rollers be held in place by a plurality of carefully placed rivets making difficult the replacement of any rollers that become damaged in use. To overcome the expensive manufacture and repair of the prior art open end ratcheting wrenches, applicant has developed the ratcheting wrenches disclosed below.

SUMMARY OF THE INVENTION

The invention comprises a closed or open end ratchet wrench head having a plurality of recesses or pockets formed in the hollow cylindrical body and in communication with the central opening. A plurality of flexible swinging pawls that act as jaw members are positioned in the recesses and extend into the central opening for driving engagement with a nut or bolt head. The pawls are preferably formed of high strength spring steel suitably tempered and heat treated for abrasion and impact resistance in combination with resilience for spring action and fatigue resistance The recesses and swinging pawls are shaped and sized to radially retain the pawls within the recesses without additional fastening means. The pawls are free to flexibly swing as required during ratcheting movement. In the case of hexagonal nut or bolt wrenches, the swing or flex is about 21° to clear the nut corners during ratcheting movement.

The swinging flexible pawls eliminate the need for separate hardened steel pawls and springs and additional means to retain the pawls in the pawl pockets. The cylindrical body is preferably formed from pressed and sintered powered metal thereby eliminating or minimizing subsequent machining or grinding steps to form the recesses or pockets.

Maintenance and repair of the wrench is facilitated by two flat cover plates removably fastened to either side of the wrench head. The plates retain the pawls axially and when removed a damaged pawl can be easily slid from the pocket and replaced. Individual pawls can be replaced as necessary.

In a alternate embodiment that also advantageously utilizes powdered metal technology for the wrench head, the pawls comprise hardened metal slugs extending into the central opening from peripheral recesses tangentially in communication with the central opening. The pawls are urged into the central opening by separate springs within the pawls and recesses. The pawls engage the nut flats with area contact and are supported with area contact by thrust walls in the wrench head recesses. The pawl is under a compressive load with driving engagement providing maximum strength with minimum size.

In a second alternate embodiment channel or "C" shaped hardened metal pawls extend partially into the central opening from substantially triangular shaped peripheral recesses. Each peripheral recess includes an undercut shoulder to retain the pawl and a small leaf spring both of which are engaged in the recess. The leaf spring urges the pawl into contact with one side of the recess but permits the pawl to swing toward the other recess wall for ratcheting movement of the wrench.

In all three embodiments of the wrench the recesses are sized and positioned to eliminate or minimize overlap of the recesses, thereby assuring that compressive forces applied to the body are not directed toward or through adjacent recesses.

DESCRIPTION OF THE DRAWINGS

FIG. 11 is a partially cutaway side view of a second alternate form of the ratchet wrench;

FIG. 12 is a left hand end view of the wrench of FIG. 11;

FIG. 13 is a cutaway and exploded view in perspective of a single pocket, leaf spring and pawl assembly;

FIG. 14 illustrates an alternate size of pawl that can be used in the wrench of FIG. 11;

FIG. 15 is a partially cutaway side view of the wrench of FIG. 11 illustrating ratcheting movement; and FIG. 16 is a left hand end view of the wrench as shown in FIG. 15.

DESCRIPTION OF THE PREFERRED EMBODIMENTS

Figures 1, 2, 3, 4A, 4B, 4C, 5A, 5B, 6:
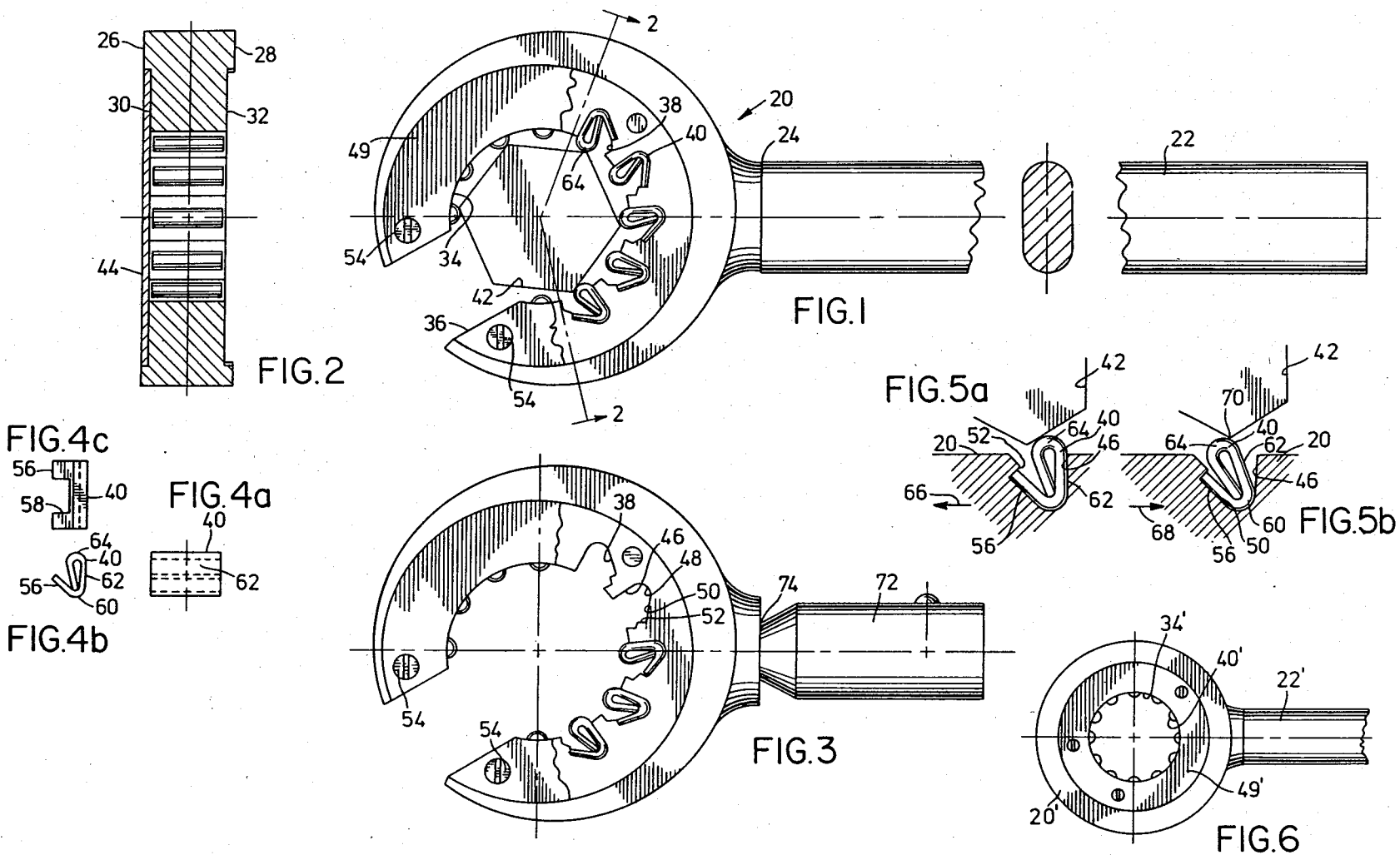
FIG. 1 is a partially cutaway view of the ratchet wrench.
FIG. 2 is a cross sectional view of the wrench taken along the line 2—2 in FIG. 1.
FIG. 3 is a partially cutaway side view of the ratchet wrench with some pawls deleted.
FIGS. 4*a, b,* and *c* are respectively side, edge and top views of a pawl.
FIG. 5*a* illustrates in partial cutaway section a pawl in driving engagement.
FIG. 5*b* illustrates in partial cutaway section a pawl in ratcheting engagement.
FIG. 6 illustrates in partial side view a closed end form of the ratchet wrench.

In FIGS. 1 and 2 the wrench comprises a head generally denoted by 20 attached to a handle 22 by a welded joint at 24. Both sides 26 and 28 of the head 20 are recessed at 30 and 32 about the central opening 34 of the head. The open end form of the wrench includes a slot 36 extending radially through the head 20 as shown.

About the periphery of the central opening 34 are a plurality of pockets or recesses 38 with pawls 40 inserted therein. The pawls 40 extend radially into the central opening 34 for engagement with a nut, or bolt head 42 illustrated schematically. The pockets or recesses 38 extend axially through the head 20. The pawls 40 are retained axially in the pockets 38 by a pair of cover plates 44 and 49 located in the recesses 30 and 32, respectively.

As best shown in FIG. 3 the pockets 38 are formed with a substantially radial thrust wall 46, bottom radius 48 and reaction wall 50. The reaction wall 50 is at approximately 45° to the thrust wall 46. The reaction wall 50 terminates at a shoulder 52 formed in the head 20. The pockets 38 are covered on each side by the cover plates 44 and 49 which in turn are retained on the head 20 by screws 54 that permit the cover plates to be conveniently removed for servicing damaged pawls 40. The configuration of the head 20 permits the manufacture of the head from sintered powdered metal to an accuracy that reduces or eliminates entirely the need for subsequent machining or grinding operations to form the pockets 38.

The pawls 40 comprise single pieces, preferably of spring steel tempered and heat treated for the maximum combination of fatigue and abrasion resistance. The pawls 40 are formed into a specific shape best illustrated in FIG. 4. The tang 56 of the pawl 40 is relieved by notching as shown at 58. The notching provides a tang 56 more flexible than the balance of the pawl 40. Alternatively, the pawl may be relieved by diminishing the tang thickness to provide more flexibility for the tang. The bend 60 of the pawl may also be relieved with diminished thickness to provide more flexibility at the bend.

The external radius at the bend 60 is substantially equal to the bottom radius 48 of the pocket 38 and the tang 56 length is selected for engagement with the shoulder 52 of the pocket. The free angle between the tang 56 and back wall 62 of the pawl 40 is greater than 45°. The pawl is squeezed to enable insertion in the pocket 38 and is thereby retained radially in the pocket.

The contact bend 64 of the pawl 40 extends inwardly into engagement with a flat of a nut or bolt head 42 as best shown in FIG. 1. Placement of the pockets 38 and pawls 40 at 30° intervals about the inner periphery of the central opening 34 provides for alternating pawl contact with a hexagonal nut. Ten pawls and pockets are required for the open end form of the wrench. In the case of a small wrench where the inner periphery of the central opening 34 is insufficient for ten pawls, the number of pawls may be reduced to five, however, the minimum ratcheting stroke is increased to 60°.

The driving and ratcheting engagements of a pawl 40 are illustrated in FIGS. 5*a* and 5*b*. In FIG. 5*a* movement of the head 20 to the left as illustrated by the arrow 66 relative to the nut 42 causes tight driving engagement with a flat of the nut 42 against the left side of the bend 64 of the pawl. The thrust wall 46 is in tight driving contact with the back wall 62 of the pawl 40. The stiffness of the pawl 40 and the engagement of the pawl tang 56 with the shoulder 52 provides a rigid driving engagement of the nut 42 by the pawl 40.

In FIG. 5*b* movement of the head 20 to the right as illustrated by the arrow 68 relative to the nut 42 causes ratcheting engagement of the nut on the right side of the bend 64 of the pawl. The pawl is caused to flex or bend about the bend 60 and the tang 56, separating the pawl 40 from the thrust wall 46. The pawl 40 is flexed until the corner 70 of the nut 42 can pass by the pawl bend 64. The acute angle (45°) between the thrust wall 46 and the reaction wall 50 prevents the pawl 40 from slipping out of the pocket 38.

FIG. 6 illustrates a closed end or box wrench form of the ratchet wrench. In the box wrench form, twelve recesses with twelve pawls 40' are spaced 30° apart about the central opening 34', the body 20' being formed of sintered powdered metal as above. Cover plates 49' retain the pawls 40' in the recesses as above.

An interchangeable wrench head stud 72 welded at 74 to the head 20 as shown in FIG. 3 may be substituted for the handle 22 or the handle 22'.

A particular advantage of the wrench embodiment of FIGS. 1 through 6 is the ability to substitute pawls of differing radial size in the same head 20. By substituting pawls of greater radial length (the distance between the bend 60 and the bend 64) a smaller hexagonal nut or bolt can be accommodated. Typically, three or four different standard metric bolt sizes can be accommodated with a single wrench head 20. The tooling cost for a set of metric wrenches can thereby be substantially reduced because the punch and die for the head is by far the most expensive portion of the tooling for a set of wrenches.

The same head can also accommodate several pawls of differing radial length for hexagonal English standard nuts and bolts. Thus, 3 or 4 head sizes and the tooling therefor is sufficient for the manufacture of English and metric wrench sets with ten to fifteen or more standard size wrenches.

FIGS. 7 through 10 illustrate an alternative form of open end ratcheting wrench which may also be constructed as a box wrench. The wrench of FIGS. 7 through 10 is also particularly suited for sintered powdered metal construction of the head 120. As above the head 120 is recessed at 130 and 132 to accommodate cover plates 144 and 149 removably attached by screws 154. The head 120 is formed with a plurality of pockets or recesses 138 communicating with the central opening 134 and extending axially through the head from recess 130 to recess 132.

Figure 7:
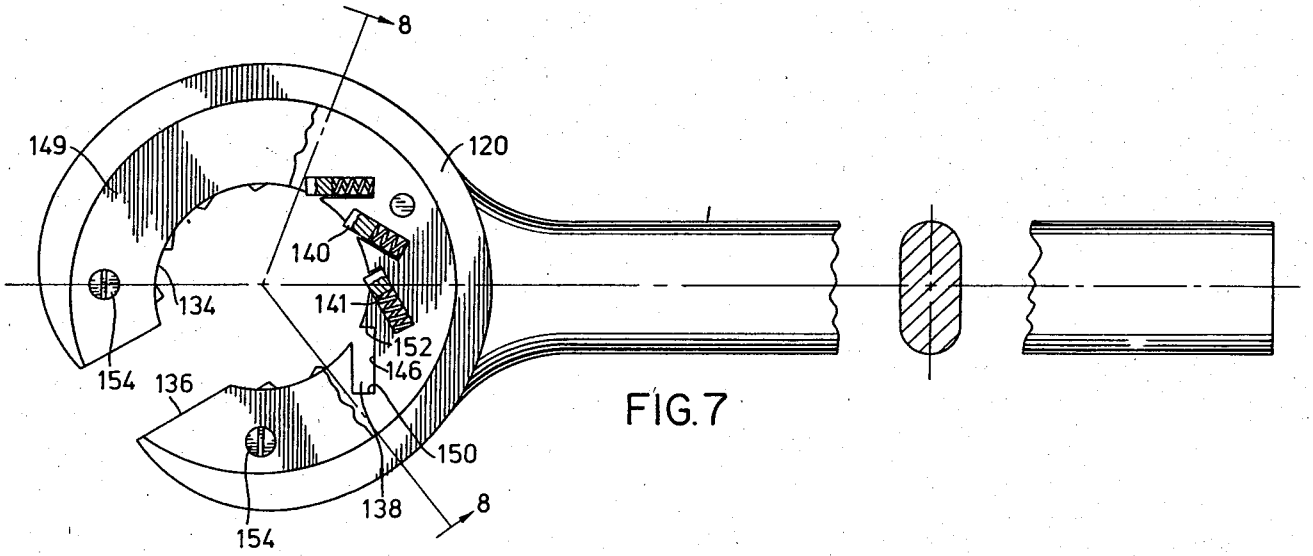
FIG. 7 is a partially cutaway side view of an alternate form of the ratchet wrench.
Figure 8:
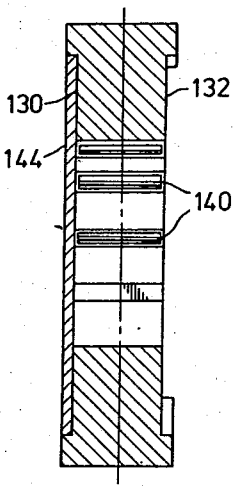
FIG. 8 is a cross sectional view of the wrench of FIG. 7 taken along the line 8—8 in FIG. 7.
Figure 9A:
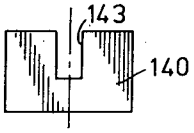
FIGS. 9*a* and 9*b* are respectively side and end views of a pawl for the alternate wrench of FIG. 7.
Figure 9B:
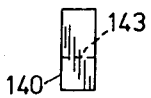

As illustrated best in FIG. 7, the pockets 138 are substantially tangential to the inner periphery of the central opening 134. Inserted in the pockets 138 are pawls 140 of metal, preferably suitably hardened and tempered steel and separate springs 141 which urge the pawls 140 into the central opening 134. As best shown in FIGS. 9 and 10 the springs 141 are located in central slots 143 formed in the pawls 140. As shown, the pockets 138 are substantially rectangular, as are the pawls 140. The pockets include a thrust wall 146, a stop wall 152 and a reacting wall 150. Reacting against the reaction wall 150, the springs 141 urge the pawls 140 against the stop wall 152.

Figure 10B:
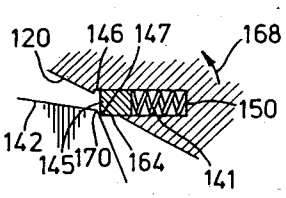
FIG. 10*b* illustrates in partial cutaway section a pawl of FIG. 9 in ratcheting engagement.
Figure 10A:
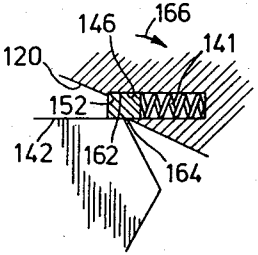
FIG. 10*a* illustrates in partial cutaway section a pawl of FIG. 9 in driving engagement.

The driving and ratcheting engagements of a pawl 140 are illustrated in FIGS. 10*a* and 10*b*. In FIG. 10*a* movement of the head 120 clockwise as shown by arrow 166 relative to the nut 142 causes tight driving engagement of the nut against the side 164 of the pawl 140 extending into the central opening 134. The thrust wall 146 is in tight driving contact with the back side 162 of the pawl 140.

In FIG. 10*b* movement of the head 120 counterclockwise as illustrated by the arrow 168 relative to the nut 142 causes ratcheting engagement of the nut 142 with the end 145 and extended corner 147 of the pawl 140. The spring 141 is compressed against the reaction wall 150 by the movement of the pawl 140 rightwardly to clear the corner 170 of the nut 142.

As above ten pockets and pawls are arranged 30° apart for an open end 136 wrench and twelve pockets and pawls arranged 30° apart for a box wrench.

Where the wrenches are to be applied to non-hexagonal bolts and nuts such as square or octagonal, the pockets and pawls may be 45° or 22½° apart respectively, and a differing number of pockets and pawls required.

In a second alternate embodiment of the wrench illustrated in FIGS. 11 through 16, channel or "C" shaped pawls 240 are inserted in substantially triangular shaped recesses or pockets 238 and retained in place by cover plates 244 and 249 as above to the wrench head 220. The pawls 240 are formed with a center channel 262 and curved top 260 and bottom 264 surfaces. The top surface 260 engages a substantially complementary pocket surface or radius 248, the pawl 240 being rotatable thereagainst.

The pocket 238 is formed with an undercut or shoulder 252 adjacent the radius 248 and the thrust wall 246. The thrust wall 246 lies in a chordal plane displaced clockwise from the radial plane parallel thereto and is substantially perpendicular to the nut flat of a nut in driving engagement with the adjacent pawl. The channel 262 back wall engages the thrust wall 246 under driving engagement in the direction of arrow 266. However, the undercut or shoulder 252 and the channel 262 are sized such that a small gap is located between the channel and the shoulder to accommodate a small bowed leaf spring 241 inserted therein as best shown in FIG. 13. The leaf spring 241 urges the pawl 240 against the radius 248 but permits the pawl 240 to rotate toward the reaction wall 250 as illustrated in FIG. 15 for ratcheting movement in the direction of arrow 268.

Returning to FIG. 11 the pawl bottom surface 264 engages a nut flat of a nut 242 adjacent a nut corner 270 and the pawl channel 262 bottom tightly engages the thrust wall 246 for driving engagement of the wrench. The nut flat engages the curved pawl bottom surface 264 slightly clockwise from a plane parallel to the thrust wall 246 and channel back wall 262 and passing through the maximum dimension of the pawl from the top surface 260 to the bottom surface 264. Thus, the major portion of the thrust from the nut is directed through the pawl to the engagement of the top surface 260 with the pocket surface 248 and only a small portion of the thrust retains the pawl tightly against the thrust wall 246. Only a small percentage of the force applied to the wrench is applied to the thrust wall 246. Rather, the enclosing wrench body surrounding and outside of the pockets is subjected to almost all of the applied force during driving engagement. In FIG. 15 ratcheting engagement of the nut corner 270 with the pawl bottom surface 264 causes the pawl 240 to rotate toward the reaction wall 250 until the nut corner 270 slides by the surface 264.

To accommodate smaller nut sizes within the wrench, the pawls 240 may be replaced by the modified pawls 240' shown in FIG. 14. The top surface 260 and channel 262 configurations remain as above to fit the pockets 238, however the pawl 240' extends radially further into the central opening 234 by means of a thicker pawl portion 265 extending to the bottom surface 264.

We claim:

1. In a ratchet wrench, a head comprising a substantially cylindrical body having a central opening extending therethrough, an inner periphery at least partially surrounding said central opening, a plurality of recesses extending radially outward from the inner periphery of the central opening, a plurality of nut engageable pawls acting as jaw members with each being retained in one of the recesses and extending into the central opening and spring means in each recess in engagement with each pawl to retain each pawl in operative engagement with the head, the improvement characterized by at least one of said recesses being formed with a thrust wall engageable by one of said pawls retained therein, said pawl comprising two convex curved surfaces joined by a central portion therebetween, the central portion being relieved on one side to form a channel having a bottom, the bottom being adapted to engage the thrust wall, said one of said recesses including an undercut forming a shoulder adjacent the thrust wall and said one of said recesses including a concave surface at a distance greater than the distance of said shoulder from the inner periphery and substantially complementary to and adapted to engage one of the convex pawl curved surfaces, said concave and said one of the convex curved surfaces extending into the undercut, the other of said convex pawl curved surfaces extending into the central opening to form a nut engageable portion of the pawl, wherein engagement by a nut on the opposite side of the other convex curved pawl surface from the thrust wall causes tight driving engagement of the nut, and wherein engagement by a nut on the same side of the other convex pawl curved surface as the thrust wall causes rotation of the pawl to permit the nut to ratchet by the pawl.

2. The wrench of claim 1 wherein said spring means comprises a spring urging the rotation of said one of said pawls into engagement with the thrust wall.

3. The wrench of claim 2 wherein the spring comprises a leaf spring engaging the shoulder and the pawl channel to urge said one of said pawls into engagement with the recess concave surface.

4. The wrench of claim 1 wherein said recesses are congruent in cross-section in the axial direction and extend through the wrench head, and wherein cover plates retain the pawls in the recesses.

5. The wrench of claim 1 including a slot extending radially and axially through said wrench head.

6. The wrench of claim 1 wherein said pawls rotate substantially 21° between said driving engagement and said ratcheting engagement.

7. A ratchet wrench head comprising a substantially cylindrical body having a central opening therethrough, an inner periphery at least partially surrounding said central opening, a plurality of recesses extending radially outward from the inner periphery of the central opening and adapted to retain a set of nut engageable pawls in the recesses, said recesses each formed with a thrust wall and a spring engaging a pawl in each recess, said set of nut engageable pawls acting as jaw members each being retained in one of said recesses, each pawl extending substantially the same distance into the central opening and including a first convex curved surface for nut engagement, said recesses each including an undercut forming a shoulder for engagement with the spring, said shoulder being adjacent the respective thrust wall and said recesses each including a concave surface at a distance greater than the distance of said shoulder from the inner periphery and extending into the undercut, and said pawls including second convex curved surfaces substantially complementary to the respective concave surfaces of the recesses and engageable therewith for rotational movement thereagainst, and said first and second convex curved surfaces of each pawl being joined by a central portion therebetween, the central portion being relieved on one side to form a channel having a bottom, the bottom being adapted to engage the thrust wall, wherein engagement by a nut on the opposite side of a pawl first convex curved surface from the thrust wall causes tight driving engagement of the nut, and wherein engagement by a nut on the same side of the pawl first convex curved surface as the thrust wall causes rotation of the pawl to permit the nut to ratchet by the pawl.

8. The wrench of claim 7 wherein the springs urge the rotation of the respective pawls into engagement with the respective thrust walls.

9. The wrench of claim 8 wherein each spring comprises a leaf spring engaging the respective shoulder and pawl to urge the pawl into engagement with the respective recess concave surface.

10. The wrench of claim 7 wherein said recesses are congruent in cross-section in the axial direction and extend through the wrench head, and wherein cover plates retain the pawls in the recesses.

11. The wrench of claim 7 including a slot extending radially and axially through said wrench head.

12. The wrench of claim 7 wherein said set of pawls is replaceable by other sets of pawls, each of said sets extending a differing distance into the central opening.

13. The wrench of claim 7 wherein said pawls are relieved on one side between said first and second convex curved surfaces to form a gap between each of the respective shoulders and pawls.

14. The wrench of claim 13 wherein a bowed leaf spring is located in each of the gaps and engages the respective shoulder and pawl to urge the pawl rotationally against the respective thrust wall.

15. The wrench of claim 7 wherein said wrench head is formed of compacted sintered metal.

16. The wrench of claim 1 wherein said wrench head is formed of compacted sintered metal.

* * * * *